US007234651B2

(12) United States Patent
Mousavi et al.

(10) Patent No.: US 7,234,651 B2
(45) Date of Patent: Jun. 26, 2007

(54) CLOSE-IN IRRIGATION SPRAY HEAD

(75) Inventors: Ali R. Mousavi, Arcadia, CA (US); Rahul R. Yarala, Thousand Oaks, CA (US)

(73) Assignee: Rain Bird Corporation, Azusa, CA (US)

( * ) Notice: Subject to any disclaimer, the term of this patent is extended or adjusted under 35 U.S.C. 154(b) by 527 days.

(21) Appl. No.: 10/821,224

(22) Filed: Apr. 7, 2004

(65) Prior Publication Data

US 2005/0224603 A1 Oct. 13, 2005

(51) Int. Cl.
*B05B 15/06* (2006.01)

(52) U.S. Cl. ..... 239/201; 239/246; 239/248; 239/249; 239/456; 239/457; 239/475; 239/514; 239/518

(58) Field of Classification Search ..... 239/200, 239/201, 246, 248, 249, 240, 476–478, 480–482, 239/456, 457, 504, 514, 518, 554, 555, 553, 239/553.5, 590, 590.5, 474, 463, 475, 568, 239/16, 17

See application file for complete search history.

(56) References Cited

U.S. PATENT DOCUMENTS 3,307,787 A * 3/1967 Hall, Jr. ..... 239/17
3,716,192 A * 2/1973 Hunter ..... 239/205
5,104,045 A 4/1992 Kah, Jr.
5,240,182 A 8/1993 Lemme
5,240,184 A 8/1993 Lawson
5,299,742 A 4/1994 Han
5,370,311 A 12/1994 Chen
5,435,490 A 7/1995 Machut
5,444,814 A 8/1995 Hofius, Sr.
5,598,977 A 2/1997 Lemme
5,642,861 A 7/1997 Ogi et al.
5,676,315 A 10/1997 Han
5,769,322 A 6/1998 Smith
6,085,995 A 7/2000 Kah, Jr. et al.
6,145,758 A 11/2000 Ogi et al.
6,158,675 A * 12/2000 Ogi ..... 239/504
6,332,581 B1 12/2001 Chin et al.
6,367,708 B1 4/2002 Olson
D458,342 S 6/2002 Johnson
6,442,372 B1 * 8/2002 Laham et al. ..... 239/514
6,464,151 B1 10/2002 Cordua
6,769,633 B1 * 8/2004 Huang ..... 239/457
2003/0010842 A1 1/2003 Kah, Jr.
2003/0057296 A1 3/2003 Huang

* cited by examiner

*Primary Examiner*—Steven J. Ganey
(74) *Attorney, Agent, or Firm*—Fitch, Even, Tabin & Flannery

(57) ABSTRACT

An improved irrigation spray head for use with pressurized water to produce a generally 360° spray pattern is provided. The spray head has a first channel that provides a water flow path in a generally vertical direction from the distal end of the spray head body to a main exit port. The spray head body includes a cavity having a geometry that, along with the first channel and the main exit port designs, causes the pressurized water to disperse radially outward away from the spray head body in the generally 360° spray pattern. A plurality of secondary channels provides secondary water flow paths from a plurality of interior ports in the cavity to a plurality of sidewall exit ports. The secondary channels result in a water flow out of the sidewall ports at a reduced water velocity thereby providing enhanced, close-in irrigation coverage.

25 Claims, 7 Drawing Sheets

CLOSE-IN IRRIGATION SPRAY HEAD

FIELD OF THE INVENTION

This invention relates to spray head type irrigation sprinklers, and more particularly to a molded plastic spray head having substantially enhanced close-in water distribution.

BACKGROUND

It has been recognized that the use of fixed or pop-up spray heads is advantageous for use in irrigation situations where the available water supply pressure is relatively low or the area to be irrigated is relatively small and irregular in shape. One reason for this is that spray heads are relatively inexpensive to manufacture and maintain, are available in a variety of full and part-circle configurations, operate on water supply pressures typically ranging between about 15 and 30 psi, and produce fan-shaped or full circle-shaped sprays which extend radially outwardly from the spray head over distances between about five and twenty feet, depending upon outlet nozzle size and water pressure.

Further, in recent years, spray heads have been developed to have matched precipitation rates so that the rate of water application produced by a given size full circle spray head is the same as that for the same size part circle spray head operating at the same supply pressure. That is, the spray heads are designed to discharge proportional quantities of water that match the arc or part of a circle they cover so that, for example, a full circle spray head discharges twice the quantity per unit time than that discharged by a half-circle spray head. Similarly a quarter-circle spray head discharges half that of a half-circle spray head.

Matched precipitation rate spray heads are available in both metal (frequently brass) and plastic (frequently molded high strength material such as ABS plastic), and normally are coupled to the outlet of a stationary or pop-up tubular riser. Pressurized water admitted to the riser is projected outwardly by the spray head nozzle outlet as a pressurized, fan-shaped spray that extends radially outwardly and upwardly away from the spray head. Ideally, the water fall-out distribution pattern produced by a spray head, like substantially any irrigation sprinkler, should be a straight line, 30 degree sloped wedge with the maximum precipitation at the spray head and zero precipitation at the maximum radius of water throw. With the ideal distribution pattern, the spacing between adjacent spray heads in an irrigation system should be equal to the maximum radial distance of throw so that the resultant precipitation rate over the area between sprinklers is uniform.

While the use of both metal and plastic spray heads have met with wide acceptance, one problem that has plagued such spray heads is their inability to disburse water in the immediate area around the spray head itself. That is, spray heads have typically produced distribution patterns which have a maximum fall-out commencing approximately two feet radially away from the spray head, and thereafter reducing to zero at the maximum distance of throw. Thus the fall-out distribution pattern of water from both metal and plastic spray heads has generally resulted in little or no appreciable water in the area extending from the spray head radially outwardly to about two feet away, thereby producing an arcuate "dead zone" extending outwardly approximately two feet.

To compensate for this problem, it is common practice in the industry to install the spray heads of a sprinkler system two feet closer together than would otherwise be necessary.

While closer spacing does help alleviate the problem of dead zones in the absence of wind, the closer spacing of spray heads results in an increase in the number of spray heads required for a given area, thereby increasing the cost of both material and labor, and total water consumption.

Early attempts to solve the problem of a lack of close-in water from spray head type sprinklers were generally commercially unsuccessful. One early attempt to resolve this problem in part-circle metal spray heads was the addition of a machined, arcuate slit in the body of the spray head below the nozzle outlet. This permits a small portion of the supply water to be disbursed as a low volume, high pressure fan-shaped spray below the main spray. Although the addition of such a machined slit improved the water distribution pattern between three and six feet radially outwardly of the spray head, it generally had little effect on the area between zero and two feet. One reason that the use of an additional machined slit is believed to have been unsuccessful in solving this problem is that the slit must be so small in size that it becomes easily clogged by dirt or rock particles in the water, thereby becoming inoperative.

U.S. Pat. No. 5,642,861 discloses a more recent, but partial solution to the problem. This solution is applicable only to sprinkler heads that produce a partial circle spray pattern. Thus, there remains a need for a full-circle spray head sprinkler having the ability to disburse water to the immediate area between zero and two feet radially outwardly from the spray head in a full circle pattern so as to more closely approximate the ideal distribution pattern.

SUMMARY OF THE ILLUSTRATED EMBODIMENTS

The present invention provides a spray head designed and constructed in such a manner that a substantial increase in the fall-out of water occurs in the area extending from the spray head outwardly to about two feet away from the spray head. Thus the over all, full-circle distribution pattern closely approximates the ideal full circle pattern, thereby minimizing the likelihood that a "dead-zone" is present in the immediate area of the spray head. Moreover, the spray head of the present invention is relatively simple in design, low in cost of manufacture and assembly, and highly reliable and effective in use to produce a matched precipitation rate spray head having superior distribution characteristics over known spray heads.

An irrigation spray head for use with pressurized water originating from a water source to produce a generally 360° spray pattern is disclosed. The spray head includes a generally cylindrical-shaped body having a cavity and further having a proximate end and a distal end. The body has a sidewall with a generally circular cross-section connecting the proximate and distal ends and defining a plurality of sidewall ports. The distal end of the body defines a distal port that can be coupled to the water source. The proximate end of the body defines a proximate port from which a relatively high velocity water spray emerges.

An interior wall, at least a portion of which has a generally concave shape, is disposed within the body and defines at least a portion of the cavity. The interior wall further defines a plurality of interior ports. The cavity and the proximate port permit the pressurized water to flow from the cavity through the proximate port and cause the pressurized water to disperse radially outward away from the body in the generally 360° spray pattern. The body defines a first channel that provides a first channel water flow path in a generally vertical direction from the distal end of the body to the cavity. The body further defines a plurality of secondary channels that provides a second channel water flow path from one of the plurality of interior ports to one of the plurality of sidewall ports. Each of the plurality of secondary channels includes a turn of greater than 70° formed in the secondary channel between one of the plurality of interior ports and one of the plurality of sidewall ports.

In one aspect, each of the plurality of secondary channels further includes a second turn of greater than 70° formed in the secondary channel between one of the plurality of interior ports and one of the plurality of sidewall ports.

In another aspect, each of the plurality of secondary channels comprises a channel section having a generally sharp-angled, polygonal cross section, such as a generally rectangular cross section, a generally square cross section, a generally pentagonal cross section or a generally hexagonal cross section.

In yet another aspect, each of the plurality of secondary channels includes an end channel portion that terminates at one of the plurality of sidewall ports. For each secondary channel, the body has a flow path top wall, a flow path bottom wall and two flow path sidewalls connecting the flow path top and bottom walls, wherein the flow path top, bottom and sidewalls define the end channel portion. The flow path sidewalls are spaced apart from one another by a progressively increasing distance.

In yet another aspect, the first channel water flow path follows a generally vertical direction, wherein the proximate port is at a first elevation above the distal port and wherein each of the plurality of sidewall ports is at a second elevation above the distal port that is less than the first elevation. Moreover, each of the plurality of interior ports is at a third elevation above the distal port that is less than the second elevation. Thus at least a portion of the secondary channel provides for a vertically upward water flow path.

In another aspect, each of the plurality of the secondary channels has a first portion extending radially outwardly from one of the plurality of interior ports, a second portion extending upwardly from the first portion, and a third portion extending radially outwardly from the second portion wherein the third portion terminates at one of the plurality of sidewall ports.

In an alternative embodiment, the first channel water flow path follows a generally vertical direction. The proximate port is at a first elevation above the distal port. Each of the plurality of sidewall ports is at a second elevation above the distal port that is less than the first elevation. Each of the plurality of interior ports is at a third elevation above the distal port that is generally the same as the second elevation. Each of the second channel water flow paths is at generally the same elevation as the third elevation. Thus each of the plurality of secondary channels provides for a generally horizontal water flow path.

In yet another embodiment, an irrigation spray head comprises a base member, a center member and a cap member. The base member has a proximate end as well as a distal end that can be coupled to a water source. The cap member is connected to the base member and disposed generally at the proximate end of the base member. The cap member has an upper cap surface that defines an upper port, a lower cap surface, and an exterior wall connecting the upper and lower cap surfaces and defining a plurality of exterior ports. The center member is disposed between the cap member upper port and the base member distal end and has center member ports through which water may flow.

The base, center and cap members define a first channel that provides a first channel water flow path from the distal end of the base member through the upper port of the cap member. The first channel and the upper port are adapted to cause the pressurized water to disperse radially outward away from the cap member in a generally 360° spray pattern. The cap member further has an interior wall that defines a plurality of interior ports. The cap member defines a plurality of secondary channels that provides a second channel water flow path from one of the plurality of interior ports to one of the plurality of exterior ports and that includes a turn of greater than 70°.

In an alternative embodiment, a spray head comprises a body having a distal end, a proximate end defining a proximate port, and a sidewall connecting the proximate and distal ends. The spray head further comprises means for coupling the water source to the distal end of the body and means for dispersing a first portion of the pressurized water through the proximate port in a direction radially outward away from the body in the generally 360° spray pattern at a first water velocity. The spray head further includes means for dispersing a second portion of the pressurized water in a direction radially outward away from the body in the generally 360° spray pattern at a second water velocity that is less than the first water velocity, said dispersing means comprising a channel that includes a turn of greater than 70° formed in the channel.

There are additional aspects to the present inventions. It should therefore be understood that the preceding is merely a brief summary of some embodiments and aspects of the present inventions. Additional embodiments and aspects of the present inventions are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

DETAILED DESCRIPTION OF THE PREFERRED EMBODIMENTS

In the following description, reference is made to the accompanying drawings which form a part hereof and which illustrate several exemplary embodiments of the present invention. It is understood that other embodiments may be used, and structural and operational changes may be made without departing from the scope of the present invention.

An irrigation spray head for use with pressurized water originating from a water source to produce a generally 360° (i.e. full-circle) spray pattern is provided. The spray head includes a base member, a center member and a cap member, all of which are secured together to form a generally cylindrical-shaped body that is formed as an integral unit.

Figure 1:
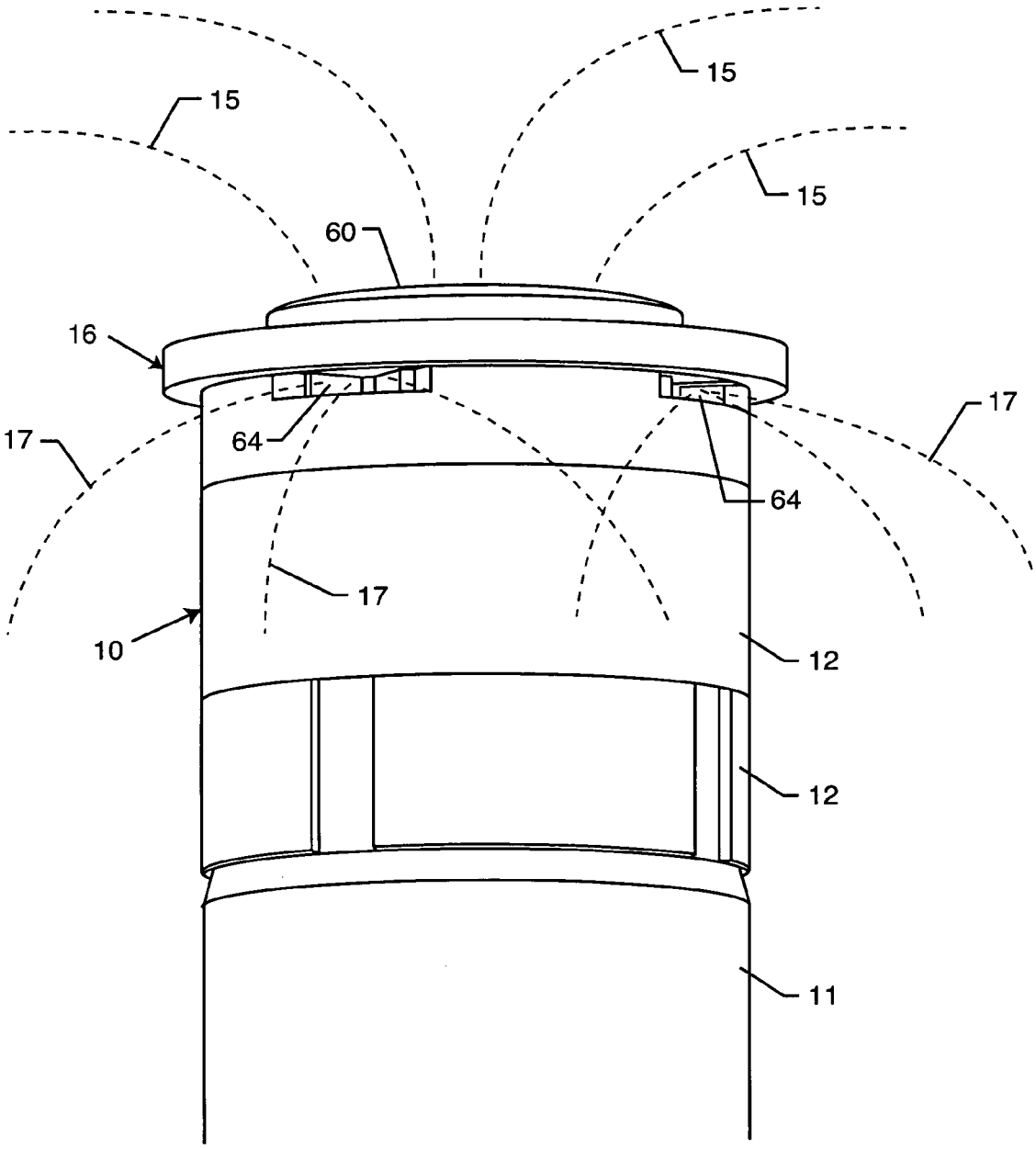
FIG. 1 is a perspective view of a spray head according to one embodiment of the invention.

As shown in FIG. 1, one embodiment of present invention includes a spray head 10 having an upper outlet or port 60 and a plurality of secondary ports 64. The spray head 10 can be coupled to the upper end of a tubular water supply pipe or riser 11, typically either the stationary riser 11 as shown, or a riser forming a pop-up stem of a pop-up spray head unit (not shown). In this instance, the spray head 10 is formed of molded plastic, such as an ABS plastic, and includes an adjustable throttling screw 18 (FIG. 2) having an enlarged head 20 at its lower end which cooperates with a tapered upper end wall of a conventional rock screen (not shown) secured between the spray head and the upper end of the riser. Typically, the riser is coupled to a suitable pressurized water source (not shown), and the throttling screw is adjusted, such as by turning the screw with a screw driver blade inserted into a slot formed in the upper end of the screw, to move the head toward or away from the tapered wall of the rock screen to control the flow of water from the riser into the spray head for adjusting the distance of water throw from the spray head.

In accordance with the present invention, the spray head is designed and constructed in such a manner that a substantial increase in the fall-out of water occurs in the area extending from the spray head outwardly to about two feet away from the spray head so that the over all distribution pattern more closely approximates the ideal, full circle-shaped pattern, thereby minimizing the likelihood of a "dead-zone" being present in the immediate area of the spray head. Moreover, the spray head of the present invention is relatively simple in design, low in cost of manufacture and assembly, and highly reliable and effective to use to produce a matched precipitation rate spray head having superior distribution characteristics over known spray heads.

Toward the foregoing needs, the spray head upper outlet or port 60 is similar in size and shape to the spray outlets or ports of known molded plastic, full circle spray heads and produces a primary, relatively high velocity spray 15. The spray head further includes a plurality of secondary outlets 64, in this instance four such secondary spray outlets or ports, that are specifically designed and constructed to produce a relatively low velocity water spray 17 effective for distributing a generally circular pattern of water close-in to the spray head over the area from about zero to about two feet away. The combined distribution pattern of water fall-out from the upper port 60 and the secondary ports 64 can produce a full circle-shaped pattern that is close to the ideal distribution pattern.

Figure 2:
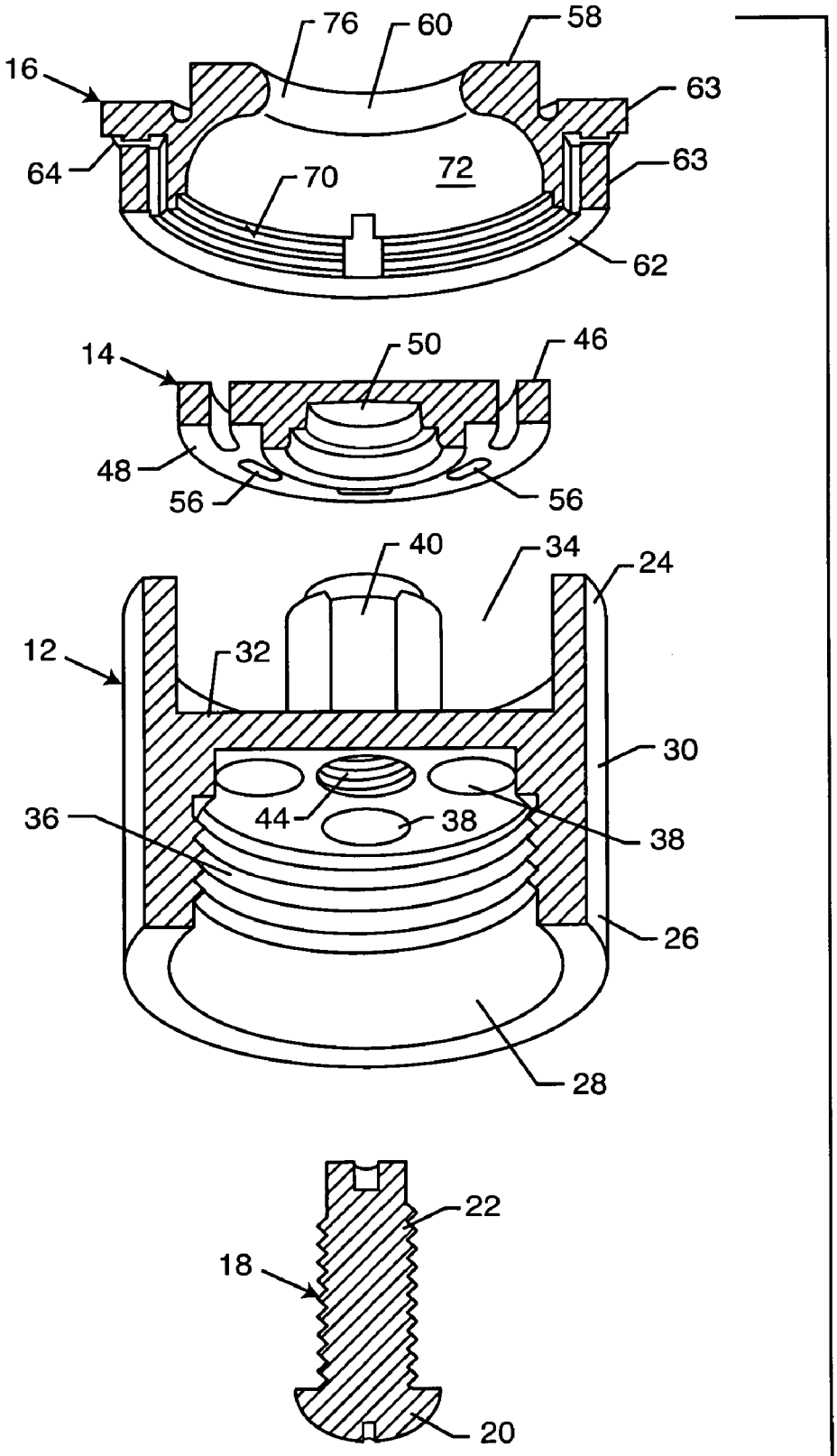
FIG. 2 is an exploded, perspective, cross-sectional view of the spray head of FIG. 1
Figure 3:
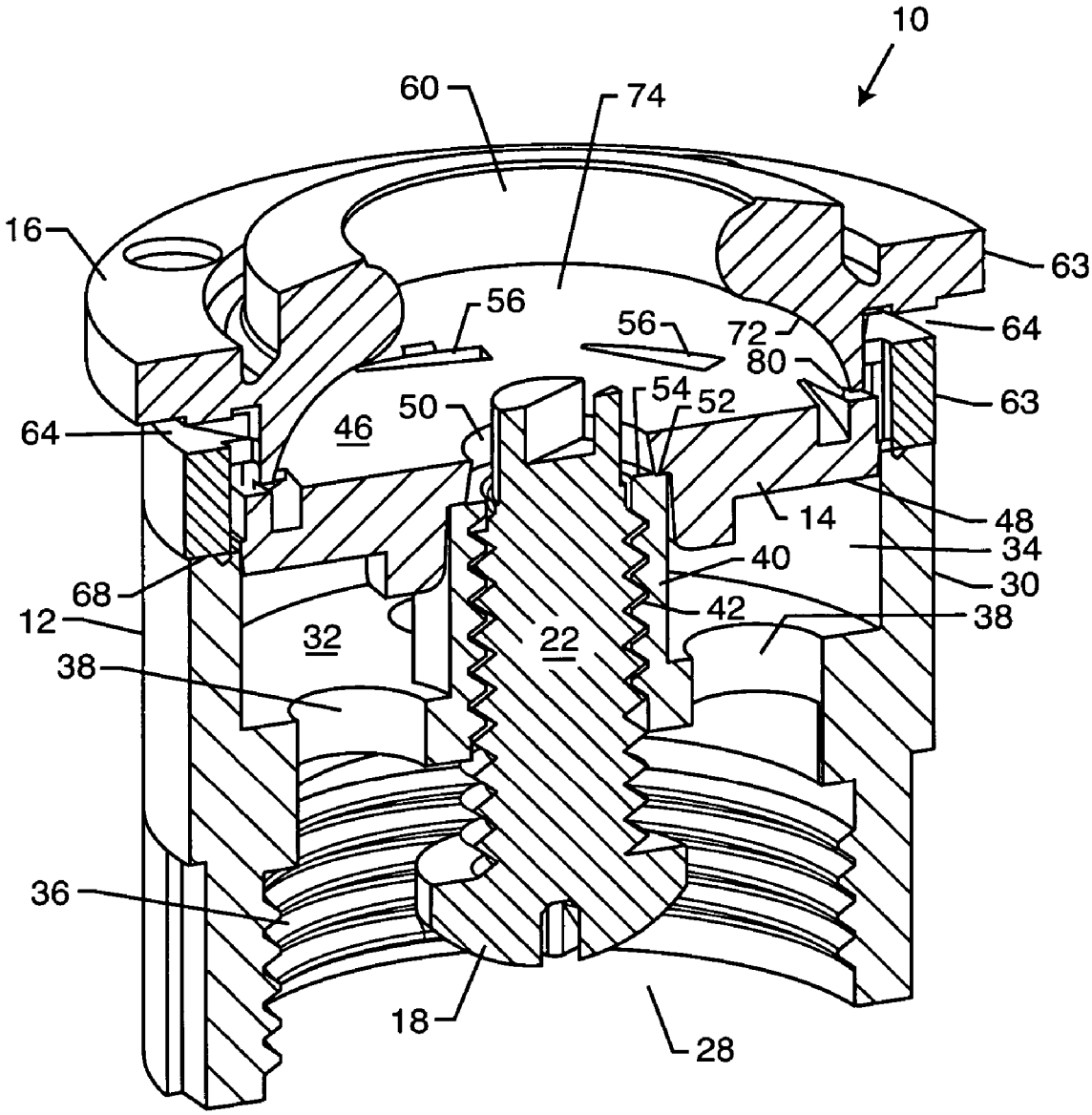
FIG. 3 is a perspective, cross-sectional view of the spray head of FIG. 1.

With primary reference to the embodiment shown in FIGS. 2 and 3, there is shown a molded plastic, full-circle matched precipitation rate spray head. The spray head 10 is formed as a generally cylindrical-shaped body from three interrelated, but separate, molded plastic components comprising a base member 12, a center member 14 and a cap member 16. The spray head 10 is assembled by stacking the three plastic components 12, 14, 16 vertically together with the cap member 16 or deflector cap on top, the base member 12 on the bottom, and the center member 14 (or swirl plate) disposed between the two. During assembly, the three plastic components 12, 14, 16 are bonded together, such as by welding, to produce an integral unit. A throttling screw 18 having a rounded head 20 and a shank 22 is then inserted into the spray head 10 after assembly of the molded plastic components.

The base member 12 is a generally cylindrical-shaped piece having a proximate end 24 and a distal end 26. The distal end 26 defines an internally threaded port 28 for coupling the distal end 26 of the base 12 to a water source, such as the water supply riser 11. (FIG. 1) The base member 12 has an outer wall 30 with a generally circular cross section and a laterally-oriented, circular-shaped interior wall 32 having generally flat upper and lower surfaces. The interior wall 32 is disposed within the outer wall 30 thereby defining an upper cavity 34 and lower cavity 36 in the base member 12. Four symmetrically-disposed ports 38 are defined by the interior wall 32 and permit the passage of water from the lower cavity 36 to the upper cavity 34 as will be explained further below.

A post 40 having an internally threaded bore 42 extends vertically upward from the center of the interior wall 32 into the upper cavity 34 of the base member. The threaded bore 42 continues through the center of the interior wall thereby defining a center bore opening 44 leading into the lower base member cavity 36. The bore 42 is adapted to threadedly engage the throttling screw 18 which may be twisted into and through the bore 42 so that the screw shank 22 extends above the proximate end 24 of the base 12 as best seen in FIG. 3.

The center member 14, or swirl plate, is a circular-shaped disk having a proximate side 46 and a distal side 48. The center member 14 defines a circular-shaped center opening 50 that is located generally at the axis and is sufficiently large in diameter to permit the shank 22 of the throttling screw 18 to extend through the opening 50. The diameter of the center member 14 is less than the inner diameter of the base member upper cavity 34 thereby permitting the center member 14 to fit within the upper cavity 34 as best seen in FIG. 3. A ledge 52 is formed around the circumference of the center opening 50 of the center member thus permitting the center member 14 to abut or mate with a top surface 54 of the base member post 40 at the base member proximate end 24 so that the center member 14 is seated within the base member 12 in a spaced-apart relationship from the base member interior wall 32. When so positioned, the center member 14 serves as a lid for the base member upper cavity 34.

The center member 14 further defines a plurality of center member flow ports 56 that are symmetrically disposed in a generally circular pattern around the center opening 50. The ports 56 are shaped so as to induce a counter clockwise swirl or flow of water that passes from the upper cavity 34 of the base member 12 through the center member ports 56.

Figure 5:
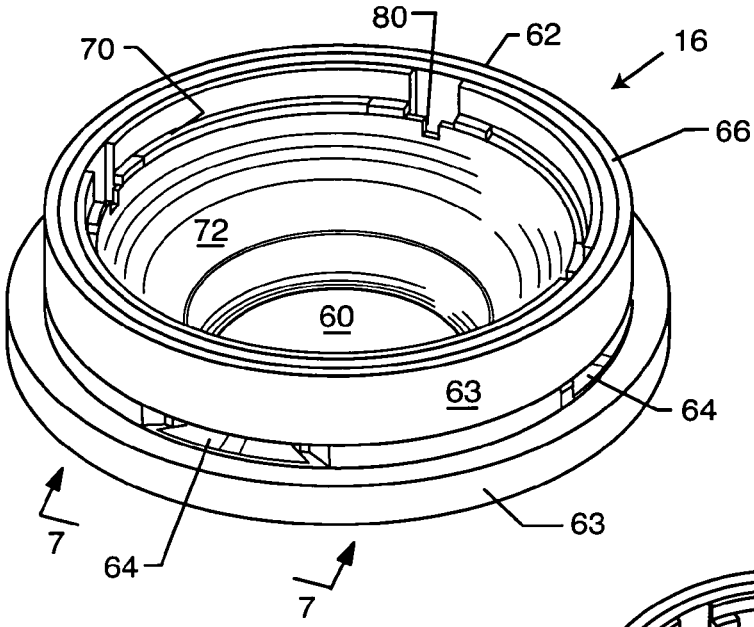
FIG. 5 is a bottom perspective view of the cap member portion of the spray head of FIG. 1.

The cap member 16 is a cylindrical-shaped piece having an upper surface 58 that defines an upper port 60, a lower surface 62, and an exterior wall 63 that connects the upper and lower cap surfaces 58, 62 and that defines four exterior or secondary ports 64. Referring to FIG. 5, the cap member 16 includes an annular-shaped ring portion 66 that includes the lower surface 62 that abuts the proximate end of the base member outer wall 30. The ring portion 66 further includes an inner shoulder 70 that is concentric with the lower surface 62. The shoulder 70 is adapted to abut the proximate side 46 of the center member 14 around the periphery of the center member thus providing a seat for holding the center member in place against the upward-directed water pressure. An interior wall 72 is disposed within the cap member 16 and defines a portion of a cavity 74 that is formed when the cap member 16 abuts the center member 14. (FIG. 3) A portion of the interior wall 72 is concave in shape in order to direct and shape the flow of water exiting the upper port 60 so that the water can disperse in the desired, full-circle spray pattern.

Figure 4:
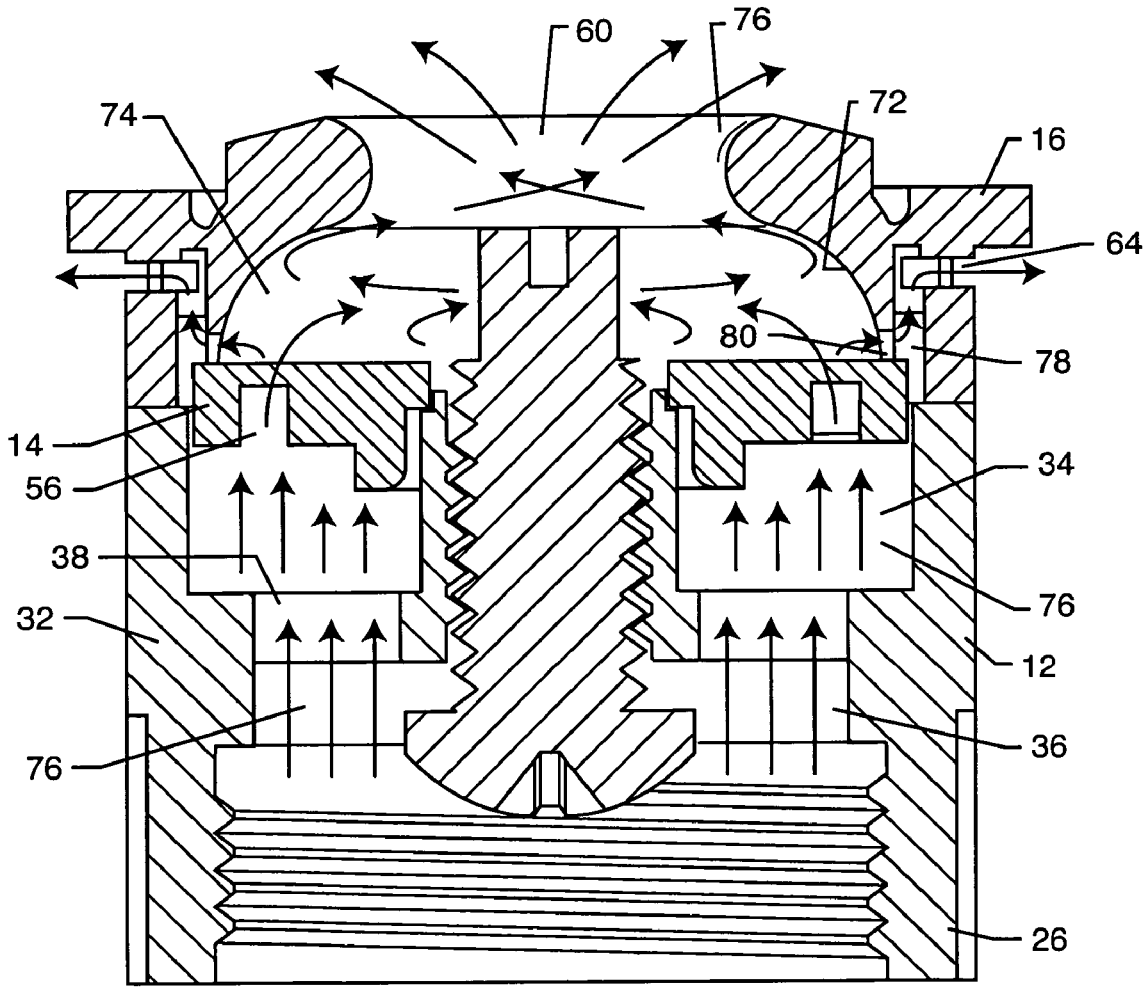
FIG. 4 is a cross-sectional view of the spray head of FIG. 1 showing the path of water flow through the spray head.

Referring to FIG. 4, when the base, center and cap members 12, 14, 16 are assembled, they define a primary channel 76 that provides a water flow path that follows a generally vertical direction from the distal end 26 of the base member 12 to the cap member cavity 74 and through the upper port 60 of the cap member 16. The primary channel 76, the cavity 74 and the upper port 60 are adapted to disperse a portion of the pressurized water radially outward away from the cap member in the generally 360° spray pattern.

More specifically, pressurized water enters the base member lower cavity 36 and is directed through the spray head 10 as follows: First, the water flows from the lower cavity 36 and passes through the four ports 38 in the base member interior wall 32. The water then flows into the base member upper cavity 34 and through the center member ports 56. The shape of these ports 56 (see FIG. 3) causes the water to flow in a counter clockwise swirl or flow as the water enters the cap member cavity 74. The water, which at this point is at a substantially reduced velocity compared to that at the base member lower cavity 36, swirls within the cap member cavity 74, and a large portion of this water exits through the cap member upper port 60. The generally concave-shaped interior wall 72 and a rounded lip 76 that defines the upper port 60 contribute to the shaping of the water flow so that it disperses the water through the upper port 60 radially outward from the spray head 10 in a generally 360° spray pattern.

Figure 8:
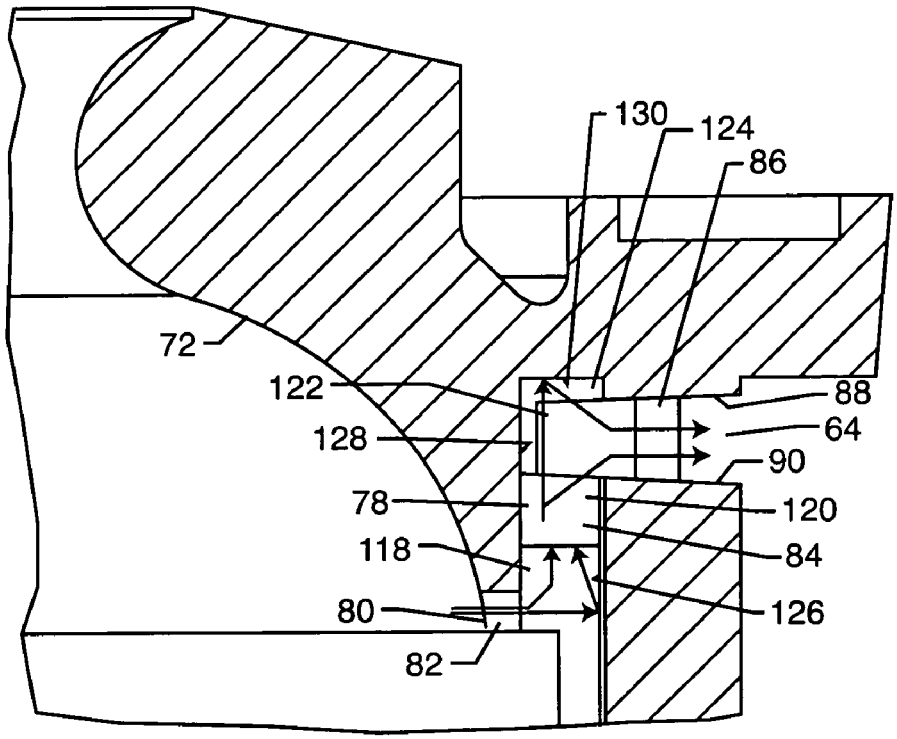
FIG. 8 is an enlarged cross-sectional view of a secondary channel of the spray head of FIG. 4 showing the path of water flow through the secondary channel.

The cap member 16 defines four secondary channels 78 each of which provides a water flow path for a portion of the swirling water in the cavity 74 to flow from one of four interior ports 80 formed by the interior wall 72 to one of the secondary ports 64. Referring to FIG. 8, each of the secondary channels 78 includes a first portion 82 that extends radially outwardly from one of the interior ports 80. Each channel 78 then turns approximately 90° and includes a second portion 84 extending upwardly from the first portion 82. Each channel then turns again approximately 90° and includes a third portion 86 that extends radially outwardly from the second portion 84 of the channel 78 and terminates at one of the secondary ports 64.

Figure 9:
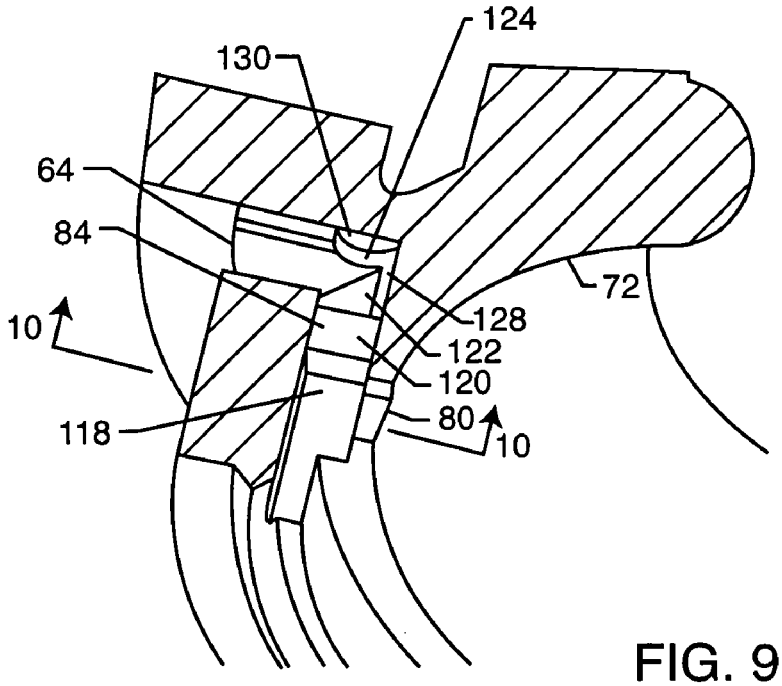
FIG. 9 is an enlarged, perspective cross-sectional view of the secondary channel of FIG. 8.
Figure 10:
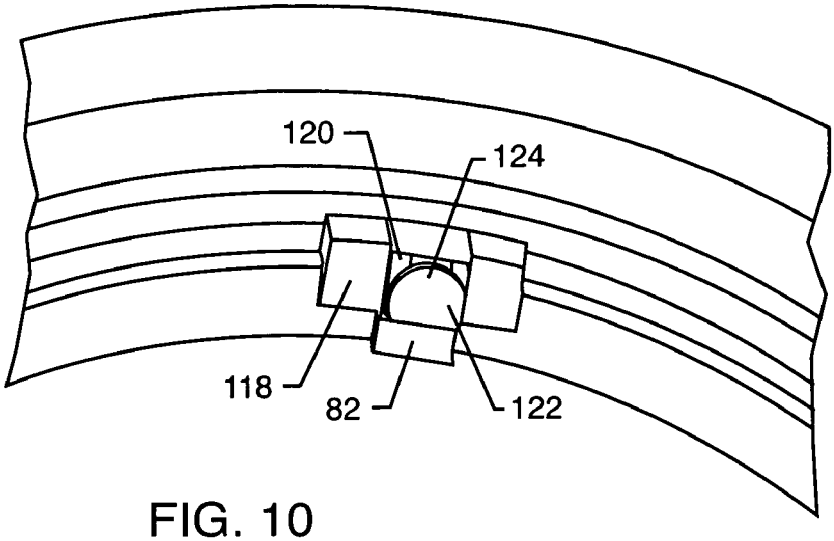
FIG. 10 is an enlarged, bottom, perspective cross-sectional view of the secondary channel of FIG. 9 taken substantially along the lines 10-10 of FIG. 9.

Referring to FIGS. 9 and 10, the second portion 84 of the secondary channel 78 includes sections having different cross sections. A lower or first section 118 has a generally rectangular cross section. As shown by the arrows in FIG. 8, a portion of the water entering this section of the channel having higher velocity impacts and reflects off of a planar-shaped wall 126 that is disposed opposite from the interior port 80 thereby reducing the water velocity. Moreover, it is believed that because the walls in the first section 118 are planar-shaped, as opposed to circular-shaped or curve-shaped, this assists in reducing the swirling nature of the water thereby further conditioning the water flow characteristics for a more desirable, uniform spray pattern when the water exits the secondary port 64.

The water in the second portion 84 of the secondary channel 78 flows from the first section 118 to a middle or second section 120 having a generally square-shaped cross section. The cross section of this middle section 120 has a smaller area than that of the first section 118, but nevertheless has generally planar-shaped side walls for further reducing the swirling direction of water flow. This middle section 120 provides for a transition of the water flow to an upper or third section 122 of the second portion 84 of the secondary channel 78. The third section 122 is generally cylindrical in shape and includes a generally curved sidewall 128 and an upper recessed area 124 having a generally circular-shaped cross-section. As shown by the arrows in FIG. 8, the higher velocity portions of the water flowing into the third section 122 will deflect off of an end wall 130 in the recessed area 124 thereby further reducing the water velocity. Moreover, the generally curved sidewall 128 and generally cylindrical-shaped recessed area 124 further assist in shaping the flow of the water for an optimum output spray pattern at the secondary port 64.

Figure 7:
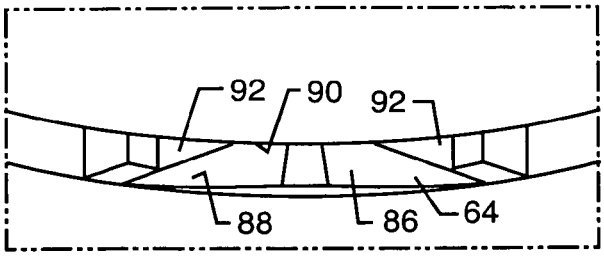
FIG. 7 is an enlarged bottom perspective view of a secondary port of the cap member of FIG. 5 taken substantially along the line 7-7 of FIG. 5.

As best seen in FIG. 7, the third or end channel portion 86 of the secondary channel 78 is formed by a top wall 88, a bottom wall 90 and two sidewalls 92 that connect the top and bottom walls. The two sidewalls 92 are spaced apart from one another by a progressively increasing distance in order to further shape the water spray pattern.

The two turns of approximately 90° each formed in each of the secondary channels 78 provide a sufficiently tortuous flow path that the water velocity at each exterior secondary port 64 is lower than the velocity at each interior port 80 and is lower than the water velocity at the cap member upper port 60. Additionally, the secondary port 64 is at a greater elevation than the interior port 80 thus using the force of gravity to further assist in reducing the water velocity.

The water velocity is sufficiently low that the resulting secondary spray pattern will cover the ground for close-in irrigation, i.e., at a distance from about two feet away from the spray head to about zero feet away. Moreover, the shape of the end channel portion 86 of each of the four, equally-spaced secondary channels 78 is such that the spray from each channel will spread out in a radial, wedge-shaped pattern of approximately 90°. Thus the combined effect of the spray pattern for all of the secondary channels 78 is to disperse the water in a direction radially outward away from the spray head 10 in a generally 360° spray pattern at a lower water velocity than the water velocity at the upper port 60, thereby providing a generally full-circle, close-in spray pattern around the spray head 10.

While the illustrated embodiment shows secondary channels 78 that each have two turns of about 90°, it will be appreciated by those skilled in the art that alternative embodiments may include channels having a greater or lesser number of turns and having a greater or lesser turn angle, so long as the resulting exit water velocity is sufficiently reduced that water covers the ground at a distance from about two feet away from the spray head to about zero feet away. For example, a channel having at least one turn of greater than 70° (along with perhaps one or more additional turns of less than this amount) may be employed to suitably reduce the water velocity. More preferably, a channel having at least two turns of greater than 70° (along with perhaps one or more other turns of less than this amount) may more efficiently reduce the water velocity.

While the secondary channel 78 of the illustrated embodiment includes the second portion 84 with sections having generally rectangular and generally square cross sections, alternative embodiments include sections having other faceted or generally sharp-angled, polygonal-shaped cross sections, other than, perhaps, a triangle-shaped cross section which may not be workable or practical. Examples of other, workable geometries however may include a generally pentagonal cross section, a generally a hexagonal cross section, or any other polygonal cross section. These faceted cross sections likewise are believed to be superior in reducing the swirling of the water and in conditioning the water flow as compared with a channel section having a curved or circular cross-section.

Moreover, while the illustrated embodiment shows four secondary channels connecting four secondary (or exterior) ports and four interior ports, it will be appreciated that a greater or lesser number of secondary channels and ports may be used in alternative embodiments of the invention, so long as the geometry and arrangement produce a generally 360° spray pattern for close-in irrigation.

Figure 6:
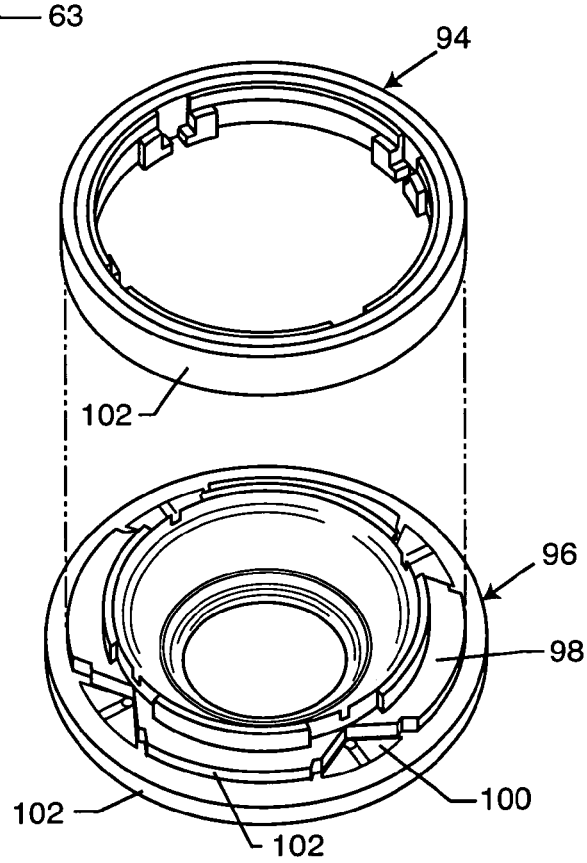
FIG. 6 is an exploded, bottom, perspective view of a cap member portion of a spray head according to an alternative embodiment of the invention.

The cap member 16 can be molded as a single piece using a mold with four slides for the four lateral ports. Alternatively however, as shown in FIG. 6, a cap member can be molded in two pieces, i.e., a lower annular member 94 and an upper deflector member 96, each of which can be easily molded. The lower annular member 94 is adapted to be seated on an annular ledge 98 of the upper deflector member 96 and welded or otherwise secured at that location. These pieces when so attached then form the desired undercut torturous path and the secondary port 100 in the cap member exterior wall 102. Once the two pieces are attached, they operate much the same as the single piece cap member.

Figure 11:
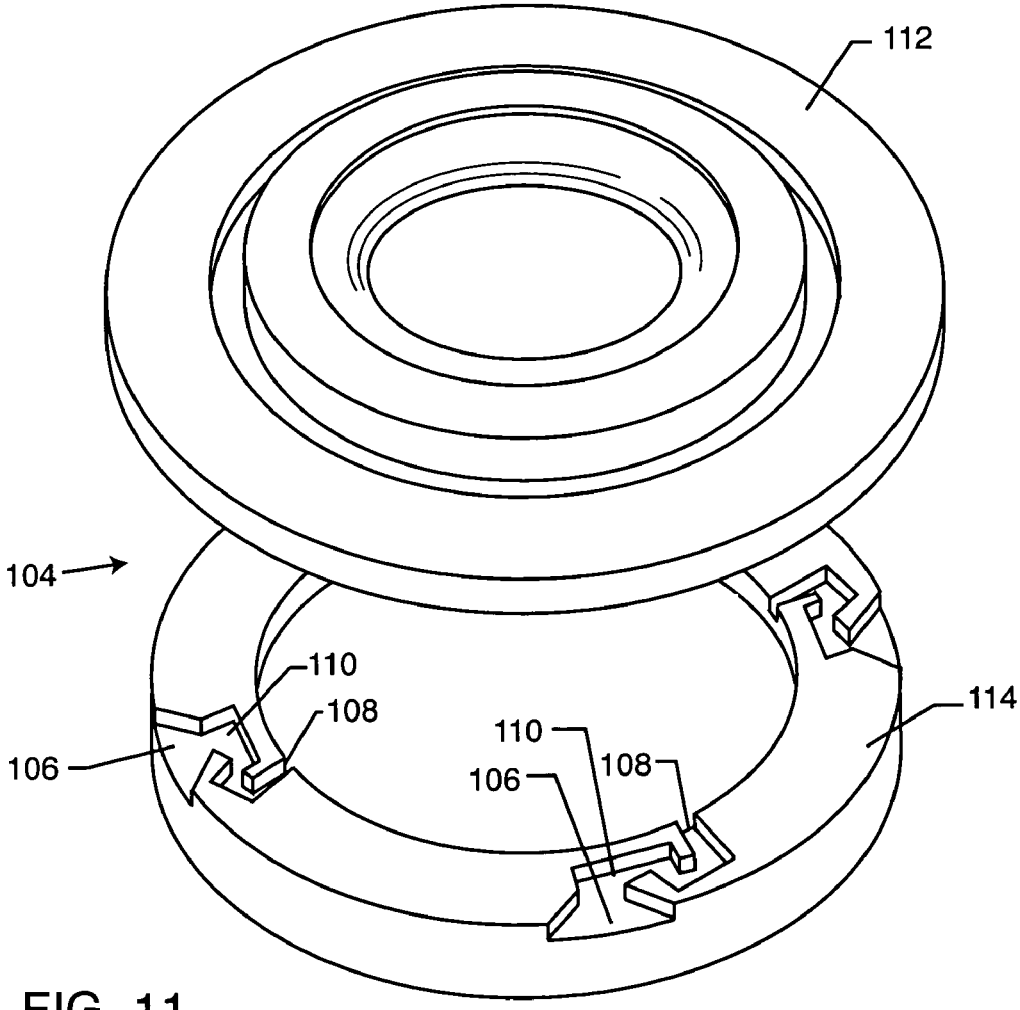
FIG. 11 is an exploded perspective view of a cap member portion of a spray head according to an alternative embodiment of the invention.

The previously-described embodiments included secondary channels 78 providing for a vertical flow of water for at least a portion of each channel. As shown in FIG. 11, however, an alternative embodiment provides for only horizontal flow. A cap member 104 is disclosed that has an upper deflector member 112 and a lower annular member 114. The lower annular member 114 defines four exterior or secondary ports 106 and four interior ports 108 that are at approximately the same elevation as each other. Horizontal channels 110 formed in the lower annular member 114 connect the secondary and interior ports 106, 108 and have a sufficiently tortuous path to provide the desired, reduced water velocity at the secondary ports 106 for close-in irrigation. The upper deflector member 112 can be welded on top of the lower annular member 114 thereby providing an upper wall for each of the secondary channels 110.

With the present invention, it has been found that by incorporating the secondary channels and secondary ports into the design of a conventional molded plastic full-circle spray head such as that marketed by Rain Bird Corporation of Glendora, Calif., the amount of water applied to the ground in the generally full-circle area extending outwardly from the spray head to approximately two feet can be substantially greater than with a conventional spray head. Moreover, the addition of the secondary channels and exterior secondary ports do not result in any appreciable reduction in the maximum range achieved of the primary spray, but merely redistributes the water over the generally full-circle area so that the resultant distribution pattern very closely approximates the ideal.

An important advantage achieved by the present invention is that each of the molded plastic base member, center member, and deflector cap member components can be inexpensively and relatively easily molded without requiring complex molds or dies. That is, each of the components can be readily molded using either straight-pull techniques or mold slides and without requiring multiple molding steps. Further, the spray head can be quickly and easily assembled, and requires only a modest amount of welding or bonding to attach the base, center and cap members together.

From the foregoing, it should be apparent that the present invention provides a molded plastic spray head which is relatively simple in design, low in cost of manufacture and reliable in use, and which can be readily adapted to form a spray head for irrigating a generally full-circle segment about the spray head. Moreover, the spray head of the present invention is highly effective in use and substantially reduces the "dead zone," thereby permitting the spray heads to be spaced further apart without a great sacrifice in water application uniformity.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. A spray head for use with pressurized water originating from a water source to produce a generally 360° spray pattern, comprising:

a body having a proximate end, a distal end, and a sidewall connecting the proximate and distal ends, said sidewall defining a plurality of sidewall ports, said body further having a cavity;

wherein the distal end of the body defines a distal port adapted to be coupled to the water source and wherein the proximate end of the body defines a proximate port;

an interior wall disposed within the body and defining at least a portion of the cavity, said interior wall further defining a plurality of interior ports;

wherein the body further defines a first channel and a plurality of secondary channels, the first channel being adapted to provide a first channel water flow path from the distal end of the body to the cavity, and each of the plurality of secondary channels being adapted to provide a second channel water flow path from one of the plurality of interior ports to one of the plurality of sidewall ports;

a member disposed within the body and defining at least one swirl port, the at least one swirl port situated in the first channel water flow path for inducing a circumferential flow component to water in the cavity;

wherein the at least one swirl port, the cavity and the proximate port are adapted to permit the pressurized water to flow from the at least one swirl port through the cavity through the proximate port and to disperse the pressurized water radially outward away from the body in the generally 360° spray pattern;

wherein each secondary channel defines a pressure-reducing tortuous flow path to reduce the velocity of water flowing therethrough and is adapted to disperse water in a wedge-shaped spray pattern to an area close to the spray head relative to water dispersed from the proximate port; and wherein the dispersion of water through the proximate port and each of the sidewall ports is continuous and unobstructed when water is supplied from the water source.

2. The spray head of claim 1 wherein each of the plurality of secondary channels comprises a channel section having one of a generally rectangular cross section, a generally square cross section, a generally pentagonal cross section and a generally hexagonal cross section.

3. The spray head of claim 1 wherein at least a portion of the interior wall has a generally concave shape.

4. The spray head of claim 1 wherein the body has a generally cylindrical shape and wherein the sidewall has a generally circular cross-section.

5. The spray head of claim 1 wherein the first channel water flow path follows a generally vertical direction.

6. The spray head of claim 1 wherein the first channel water flow path follows a generally vertical direction, wherein the proximate port is at a first elevation above the distal port, wherein each of the plurality of sidewall ports is at a second elevation above the distal port, said second elevation being less than the first elevation, and wherein each of the plurality of interior ports is at a third elevation above the distal port, said third elevation being less than the second elevation.

7. The spray head of claim 1 wherein the member comprises a disk defining a plurality of swirl ports therethrough, the swirl ports symmetrically disposed about the disk and each defining a tapered opening.

8. A spray head for use with pressurized water originating from a water source to produce a generally 360° spray pattern, comprising:

a body having a proximate end, a distal end, and a sidewall connecting the proximate and distal ends, said sidewall defining a plurality of sidewall ports, said body further having a cavity;

wherein the distal end of the body defines a distal port adapted to be coupled to the water source and wherein the proximate end of the body defines a proximate port;

an interior wall disposed within the body and defining at least a portion of the cavity, said interior wall further defining a plurality of interior ports;

wherein the body further defines a first channel and a plurality of secondary channels, the first channel being adapted to provide a first channel water flow path from the distal end of the body to the cavity, and each of the plurality of secondary channels being adapted to provide a second channel water flow path from one of the plurality of interior ports to one of the plurality of sidewall ports;

wherein the cavity and the proximate port are adapted to permit the pressurized water to flow from the cavity through the proximate port and to disperse the pressurized water radially outward away from the body in the generally 360° spray pattern;

wherein each of the plurality of secondary channels includes a first turn of greater than 70° formed in the secondary channel between one of the plurality of interior ports and one of the plurality of sidewall ports; and wherein each of the plurality of secondary channels further includes a second turn of greater than 70° formed in the secondary channel between one of the plurality of interior ports and one of the plurality of sidewall ports.

9. The spray head of claim 8 wherein each of the plurality of secondary channels includes an end channel portion that terminates at one of the plurality of sidewall ports, wherein for each of the plurality of secondary channels, the body is further comprised of a flow path top wall, a flow path bottom wall and two flow path sidewalls connecting the flow path top and bottom walls, wherein the flow path top wall, bottom wall and sidewalls define the end channel portion, and wherein the flow path sidewalls are spaced apart from one another by a progressively increasing distance.

10. A spray head for use with pressurized water originating from a water source to produce a generally 360° spray pattern, comprising:

a body having a proximate end, a distal end, and a sidewall connecting the proximate and distal ends, said sidewall defining a plurality of sidewall ports, said body further having a cavity;

wherein the distal end of the body defines a distal port adapted to be coupled to the water source and wherein the proximate end of the body defines a proximate port;

an interior wall disposed within the body and defining at least a portion of the cavity, said interior wall further defining a plurality of interior ports;

wherein the body further defines a first channel and a plurality of secondary channels, the first channel being adapted to provide a first channel water flow path from the distal end of the body to the cavity, and each of the plurality of secondary channels being adapted to provide a second channel water flow path from one of the plurality of interior ports to one of the plurality of sidewall ports;

wherein the cavity and the proximate port are adapted to permit the pressurized water to flow from the cavity through the proximate port and to disperse the pressurized water radially outward away from the body in the generally 360° spray pattern;

wherein each of the plurality of secondary channels includes a first turn of greater than 70° formed in the secondary channel between one of the plurality of interior ports and one of the plurality of sidewall ports;

wherein the first channel water flow path follows a generally vertical direction, wherein the proximate port is at a first elevation above the distal port, wherein each of the plurality of sidewall ports is at a second elevation above the distal port, said second elevation being less than the first elevation, and wherein each of the plurality of interior ports is at a third elevation above the distal port, said third elevation being less than the second elevation; and wherein each of the plurality of secondary channels comprises a first portion extending radially outwardly from one of the plurality of interior ports, a second portion extending upwardly from the first portion, and a third portion extending radially outwardly from the second portion, said third portion terminating at one of the plurality of sidewall ports.

11. The spray head of claim 10 wherein the second portion comprises a channel section having one of a generally rectangular cross section, a generally square cross section, a generally pentagonal cross section and a generally hexagonal cross section.

12. A spray head for use with pressurized water originating from a water source to produce a generally 360° spray pattern, comprising:

a body having a proximate end, a distal end, and a sidewall connecting the proximate and distal ends, said sidewall defining a plurality of sidewall ports, said body further having a cavity;

wherein the distal end of the body defines a distal port adapted to be coupled to the water source and wherein the proximate end of the body defines a proximate port;

an interior wall disposed within the body and defining at least a portion of the cavity, said interior wall further defining a plurality of interior ports;

wherein the body further defines a first channel and a plurality of secondary channels, the first channel being adapted to provide a first channel water flow path from the distal end of the body to the cavity, and each of the plurality of secondary channels being adapted to provide a second channel water flow path from one of the plurality of interior ports to one of the plurality of sidewall ports;

wherein the cavity and the proximate port are adapted to permit the pressurized water to flow from the cavity through the proximate port and to disperse the pressurized water radially outward away from the body in the generally 360° spray pattern;

wherein each of the plurality of secondary channels includes a first turn of greater than 70° formed in the secondary channel between one of the plurality of interior ports and one of the plurality of sidewall ports; and wherein the first channel water flow path follows a generally vertical direction, wherein the proximate port is at a first elevation above the distal port, wherein each of the plurality of sidewall ports is at a second elevation above the distal port, said second elevation being less than the first elevation, wherein each of the plurality of interior ports is at a third elevation above the distal port, said third elevation being generally the same as the second elevation, and wherein each of the plurality of second channel water flow paths is at generally the same elevation as the third elevation.

13. A spray head for use with pressurized water originating from a water source to produce a generally 360° spray pattern, comprising:

a base member having a proximate end and a distal end wherein the distal end is adapted to be coupled to the water source;

a cap member connected to the base member and disposed generally at the base member proximate end, the cap member having an upper cap surface, a lower cap surface, and an exterior wall connecting the upper and lower cap surfaces, wherein the upper cap surface defines an upper port;

wherein the base member and the cap member define a first channel adapted to provide a first channel water flow path form the distal end of the base member through the upper port of the cap member, the first channel and the upper port being further adapted to cause the pressurized water to disperse radially outward away from the cap member in the generally 360° spray pattern;

wherein the cap member further has an interior wall that defines a plurality of interior ports, wherein the cap member exterior wall defines a plurality of exterior ports, and wherein the cap member defines a plurality of secondary channels each of which is adapted to provide a second channel water flow path from one of the plurality of interior ports to one of the plurality of exterior ports; and wherein each of the plurality of secondary channels includes a first turn of 70° formed in the secondary channel between one of the plurality of interior ports and one of the plurality of exterior ports.

14. The spray head of claim 13 further comprising a center member disposed generally between the cap member upper port and the base member distal end and having a center member port that defines at least a portion of the first channel.

15. The spray head of claim 13 wherein each of the plurality of secondary channels further includes a second turn of greater than 70° formed in the secondary channel between one of the plurality of interior ports and one of the plurality of exterior ports.

16. The spray head of claim 13 wherein each of the plurality of secondary channels comprises a channel section having one of a generally rectangular cross section, a generally square cross section, a generally pentagonal cross section and a generally hexagonal cross section.

17. The spray head of claim 13 wherein the base member and the cap member define a generally cylindrical-shaped body when the cap member is connected to the base member.

18. The spray head of claim 13 wherein at least a portion of the cap member interior wall has a generally concave shape.

19. The spray head of claim 13 wherein the first channel water flow path follows a generally vertical direction.

20. The spray head of claim 13 wherein each of the plurality of secondary channels includes an end channel portion that terminates at one of the plurality of exterior ports, wherein for each of the plurality of secondary channels, the cap member further comprises a flow path top wall, a flow path bottom wall and two flow path sidewalls connecting the flow path top and bottom walls, wherein the flow path top wall, bottom wall and sidewalls define the end channel portion, and wherein the flow path sidewalls are spaced apart from one another by a progressively increasing distance.

21. The spray head of claim 13 wherein the first channel water flow path follows a generally vertical direction, wherein the cap member upper port is at a first elevation above the base member distal end, each of the plurality of cap member exterior ports is at a second elevation above the base member distal end, said second elevation being less than the first elevation, and each of the plurality of cap member interior ports is at a third elevation above the base member distal end, said third elevation being less than the second elevation.

22. The spray head of claim 21 wherein each of the plurality of secondary channels comprises a first portion extending radially outwardly from one of the plurality of cap member interior ports, a second portion extending upwardly from the first portion, and a third portion extending radially outwardly from the second portion, said third portion terminating at one of the plurality of cap member exterior ports.

23. The spray head of claim 22 wherein the second portion comprises a channel section having one of a generally rectangular cross section, a generally square cross section, a generally pentagonal cross section and a generally hexagonal cross section.

24. The spray head of claim 13 wherein the first channel water flow path follows a generally vertical direction, wherein the cap member upper port is at a first elevation above the base member distal end, each of the plurality of cap member exterior ports is at a second elevation above the base member distal end, said second elevation being less than the first elevation, each of the plurality of cap member interior ports is at a third elevation above the base member distal end, said third elevation being generally the same as the second elevation, and wherein each of the plurality of second channel water flow paths is at generally the same elevation as the third elevation.

25. A spray head for use with pressurized water originating from water source to produce a generally 360° spray pattern, said pressurized water including a first portion of pressurized water and a second portion of pressurized water, the spray head comprising:

a body having a proximate end, a distal end, and a sidewall connecting the proximate and distal ends, said proximate end defining a proximate port;

means for coupling the water source to the distal end of the body;

a member disposed within the body and defining at least one swirl port, the at least one swirl port inducing a circumferential flow component to the first portion of pressurized water;

means for dispersing the first portion of the pressurized water through the proximate port in a direction radially outward away from the body in the generally 360° spray pattern at a first water velocity;

means for dispersing the second portion of the pressurized water in a direction radially outward away from the body in the generally 360° spray pattern at a second water velocity that is less than the first water velocity and to an area close to the spray head relative to the first portion of pressurized water dispersed through the proximate port; and wherein the dispersion of the first portion of pressurized water and the second portion of pressurized water is continuous and unobstructed when water is supplied from the water source.

* * * * *